US005115385A

United States Patent [19]

Jeckle

[11] Patent Number: 5,115,385

[45] Date of Patent: May 19, 1992

[54] SHAPED LAMP SHADE

[76] Inventor: William A. Jeckle, N. 2215 Houk Ct. #14, Spokane, Wash. 99216

[21] Appl. No.: 647,047

[22] Filed: Jan. 29, 1991

[51] Int. Cl.[5] ..... F21V 1/04

[52] U.S. Cl. ..... 362/358; 362/412; 362/449

[58] Field of Search ..... 362/145, 147, 410, 412, 362/414, 444, 449, 358

[56] References Cited

U.S. PATENT DOCUMENTS

| | | | |
|---|---|---|---|
| 1,586,577 | 6/1926 | Raitt | 362/356 |
| 1,745,584 | 2/1930 | Sacksteder, Jr. | 362/414 X |
| 2,516,866 | 8/1950 | Halpern | D26/93 |
| 3,601,600 | 8/1971 | Cannon | 362/414 X |
| 4,217,629 | 8/1980 | Russell | 362/147 |

*Primary Examiner*—Stephen F. Husar
*Attorney, Agent, or Firm*—Wells, St. John & Roberts

[57] ABSTRACT

A lamp shade is disclosed with a formed surface thereon intended to facilitate close positioning of the shade and associated lamp closely adjacent to a structure wall. In combination, a shaped lamp shade and a shaped self supporting lamp base with a similarly shaped surface are provided to permit still further positioning in proximity to a complementary structure wall configuration. The shaped surfaces on the lamp shade, or both, may be selected to conform substantially to a flat wall surface, an outside corner of a wall surface, or an inside corner. Adjustment slide members are provided, along with horizontal lamp shade wire members, to facilitate selective adjustment of the lamp shade relative to the base toward or away from the structure wall surface.

11 Claims, 5 Drawing Sheets

SHAPED LAMP SHADE

TECHNICAL FIELD

The present invention relates to lamp shades and shapes thereof conforming to selected wall configurations.

BACKGROUND OF THE INVENTION

Conventional lamps and lamp shades have a typical circular or polygonal cross sectional configuration in which the lamp base, bulb, shade support, and shade are all substantially centered on a vertical axis. This configuration is convenient where lamps are to be positioned in open areas for use in distributing light about a 360° area. However, such lamps become obtrusive when positioned adjacent to a wall surface. The projecting shade, centered on the axis of the base, necessitates that the lamp be spaced from the wall by a distance substantially equal to or slightly greater than the radius of the shade. This creates difficulties, especially within confined areas such as small apartments where maximum space utilization is very desirable.

Various adjustable lamp shades and lamps have been provided in the past to modify the overall configuration of the shade. However, such shades are not adjustable in relation to the lamp base below and consequently must remain substantially centered on the vertical axis of the lamp base. Further, the lamp in such instances is usually attached to the lamp shade. U.S. Pat. No. 2,516,866 to Halpern discloses a utility lamp that includes a shaped lamp shade and integrated lamp supports substantially centered within the lamp shade. While this construction offers a partial solution to the above problems, it does not provide flexibility in the adaptation of the shade to a standard form of lamp, nor does it permit selective adjustment of the lamp shade relative to the base toward or away from a wall surface.

U.S. Pat. No. 1,586,577 to Raitt discloses a lamp shade that, like the Halpern patent, is substantially integral with the shade frame. Thus, the light and shade are not capable of adjustment relative to the base.

Although the above shade and lamp configurations provide some additional clearance capabilities, it remains desirable to conserve space within standard lamp bases. It is also desirable for the lamp shade to be adjustable in relation to the lamp base in order to accommodate various base sizes and configurations. It is further desirable to obtain specific lamp configurations in which both the lamp shade and lamp base will fit closely adjacent to a wall configuration, thereby enabling maximum space utilization while enabling use of the lamp for functional lighting and for aesthetic considerations.

BRIEF DESCRIPTION OF THE DRAWINGS

Preferred forms of the invention are illustrated in the accompanying drawings in which.

DETAILED DESCRIPTION OF PREFERRED EMBODIMENTS

This disclosure of the invention is submitted in furtherance of the constitutional purposes of the Patent Laws "to promote the progress of science and useful arts" (Article 1, Section 8).

In general terms, the present invention is embodied within a lamp shade and in a lamp shade and self supporting base combination configured to conform to a wall surface and thereby minimize the space occupied by the lamp, yet not detract from the aesthetic qualities thereof.

Figure 5:
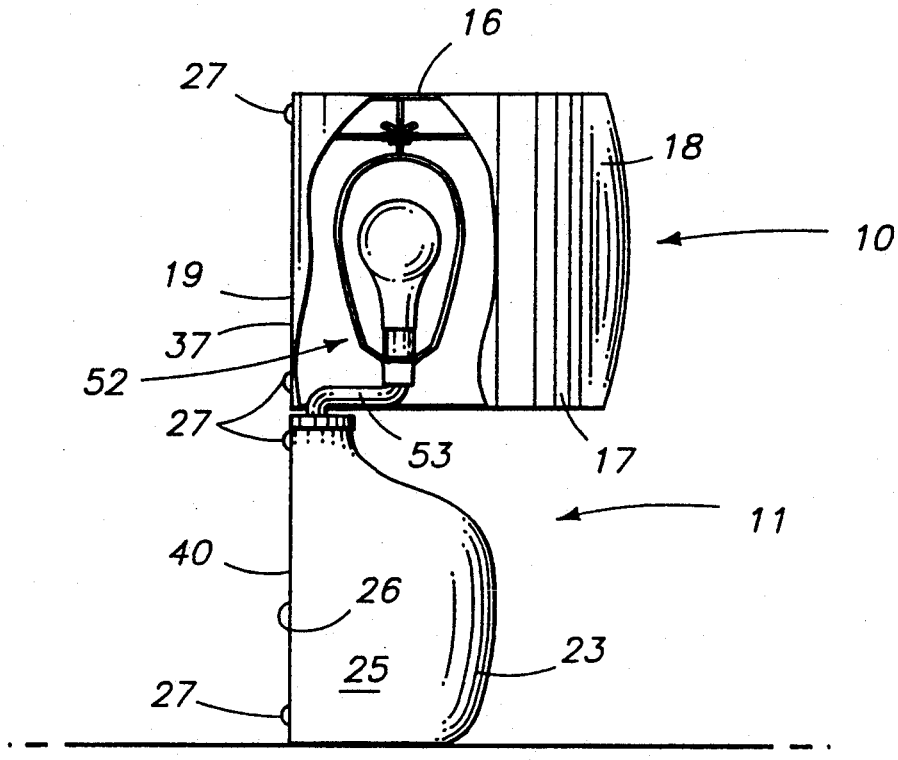
FIG. 5 is a view of another configuration for the present invention.

In general, all embodiments of the present lamp shade 10 include a lamp shade frame 13 constructed preferably of formed, relatively rigid wire 14. In all preferred forms, the shade frame 13 includes horizontal paired wire members 15 that substantially span the internal open area of the lamp shade. The paired wire members 15 are connected to shade shaping members 16 which are formed to shape the shade member 18. The particular configuration of the remaining external portion 17 of the shade 18 may take any conventional or nonconventional configuration depending upon the decorative effect desired. The present drawings illustrate the external configuration as including a frusto-conical configuration (FIG. 1), a substantially cylindrical configuration (FIG. 3), and a substantially barrel shaped configuration (FIG. 5). It is to be understood that the drawings simply exemplify a number of different configurations from the many shapes available and capable of being used in the present invention.

The present lamp shade includes a unique shaped section 19 in all embodiments that is configured to accommodate a complementary wall sufrace, and thereby permit postioning of a supporting lamp base member in close proximity to the structure wall 12.

The lamp shade 10 maybe combined with a free standing lamp base 23 to provide, in combination, a novel lamp 11. The base 23, in all configurations, includes an external base portion 25 that, like the external lamp shade section 17, may take any desired configuration. The base 23 also includes a shaped base area 26 that is configured complementary to an adjacent structure wall 12 in a plane or shaped configuration similar or identical to the shaped shade area 19. The two surfaces or areas 19, 26, facilitate positioning of the entire self supported lamp structure closely adjacent to a complementary support wall surface, thereby facilitating conservation of space while maintaining the decortaive benefits of the free standing lamp.

Both of the shaped sections 19, 26 are advantageously provided with pads or bumpers 27 to avoid scuffing the adjacent wall surface 12.

A shade mounting means 29 is included with the above preferred forms of the present invention for releasably securing the lamp shade frame 13 and lamp shade 10 to the lamp base 23 for selective adjustment of the base relative to the lamp shade toward or away from the structure wall surface.

Given the above general description of the invention, details relating to exemplary forms thereof will be described in more detail below.

Figure 1:
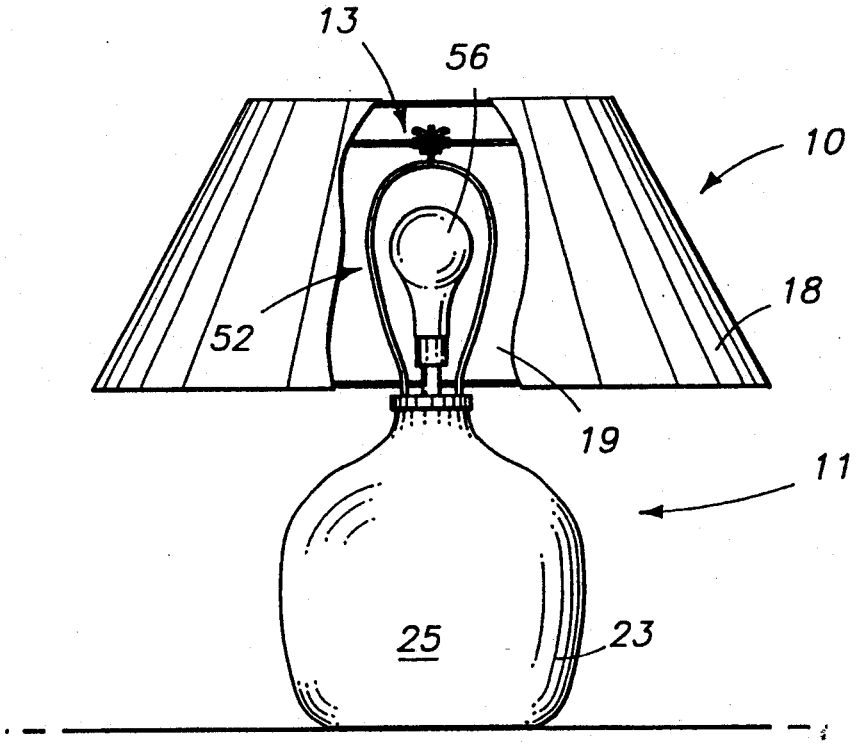
FIG. 1 is a partially fragmented elevational view of a lamp and shade embodying features of the present invention.
Figure 2:
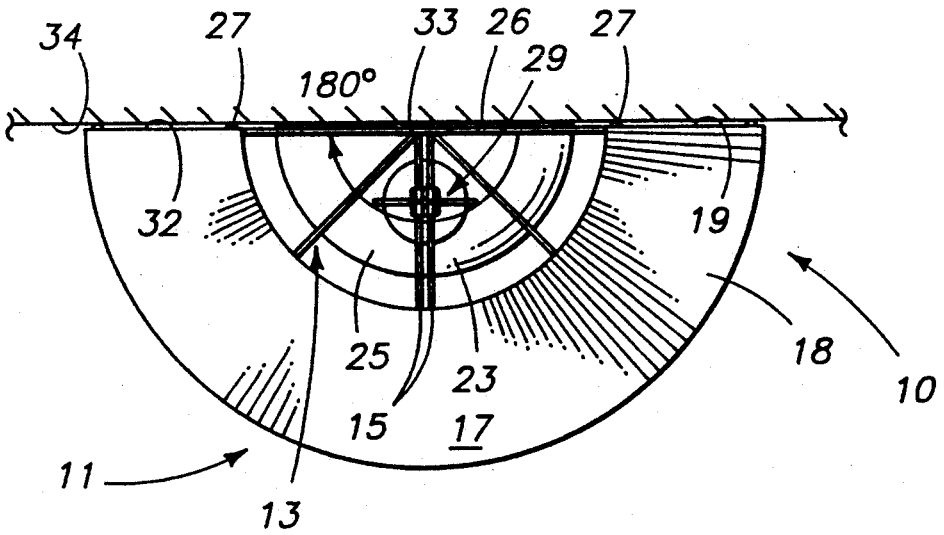
FIG. 2 is a plan view of the lamp configuration shown in FIG. 1, with a wall shown in fragmented section adjacent thereto.

Referring specifically to FIGS. 1 and 2, the present lamp shade 10 and base 23 are shown with substantially flat sections 32 and 33 respectively. The flat section 32 provided on the shade is formed substantially along a diametric plane extending vertically through the shade. This configuration is provided to facilitate close positioning of the shade, particularly the flat surface area 32 closely adjacent to a similarly flat wall area 34 as shown in FIG. 2.

The flat area 33 on the lamp base is formed along a plane that is substantially parallel to or coplanar with the flat plane of the shade surface 32. Regardless of the configuration for the lamp base, the flat area 33 is provided, substantially longitudinally sectioning the base to thereby enable close positioning of the base adjacent to the wall surface 34 again as shown in FIG. 2.

Figure 3:
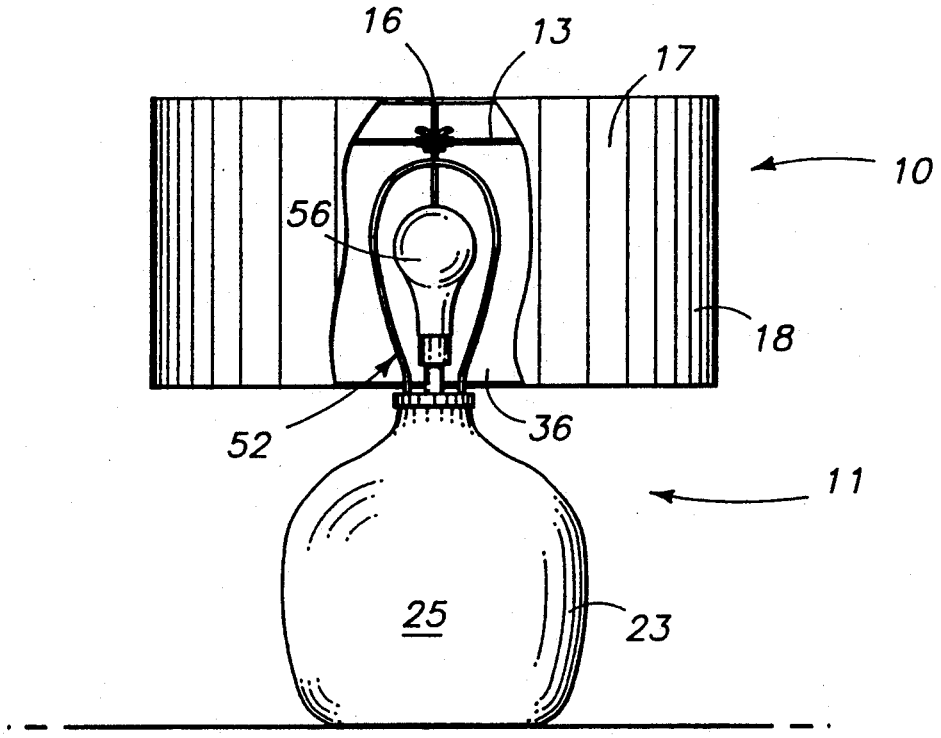
FIG. 3 is a partially fragmented elevational view of another preferred embodiment of the present invention for placement adjacent to outside corners.
Figure 4:
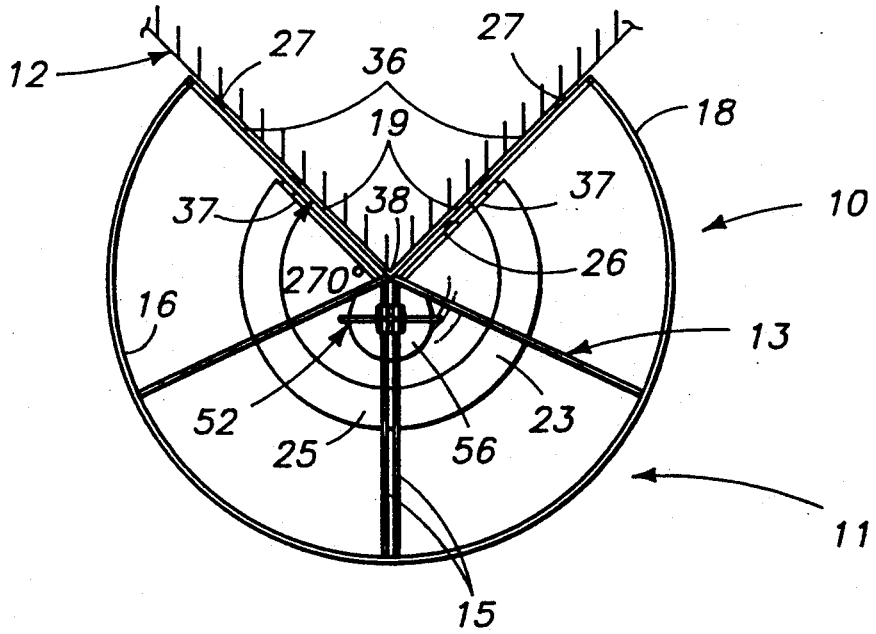
FIG. 4 is a plan view of the embodiment shown is FIG. 3 adjacent to a partially fragmented and cross sectioned wall.

FIGS. 3 and 4 are illustrative of an example for the present lamp shade 10 and lamp 11 in which a notched section 36 is provided in the shade and a notched area 37 is provided on the base. Here, the notched sections 36, 37 are formed in a wedge configuration, adapting the lamp shade and base to be positioned adjacent an outside corner 38 of the structure wall. The angle of the notched configuration is determined by the angular relationship of the wall surfaces meeting at the outside corner 38. It is anticipated that the outside angle between surfaces forming the notched sections 36, 37 will be, in most cases, 270°, thereby leavin angular clearance for a 90° corner. However, the lamp shade and base may be produced with surfaces arranged at other angles for particular wall configurations.

Figure 6:
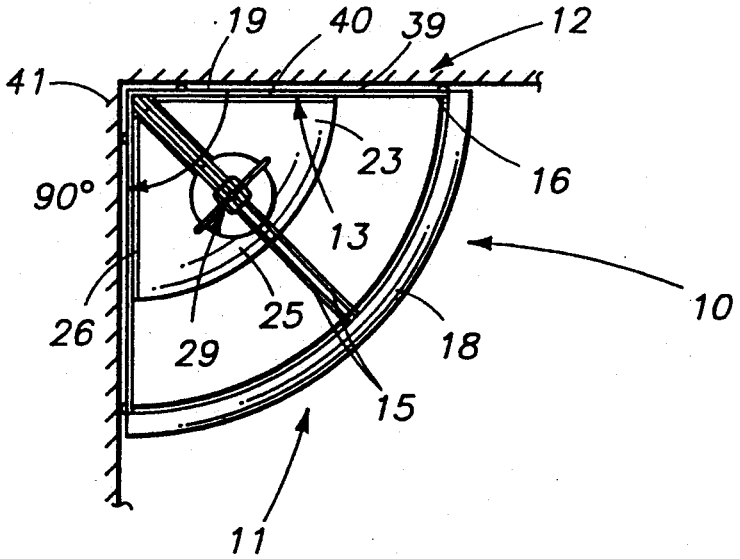
FIG. 6 is a plan view of the configuration shown in FIG. 5, with a partially fragmented and sectioned wall configuration adjacent thereto.

FIGS. 5 and 6 illustrate an example in which a wedge configuration 39 is formed in the lamp shade and a similar wedge area 40 is provided on the base. These configurations 39, 40 are provided to allow close positioning of the lamp within an outside corner 41 of a structure wall. Again, it is anticipated that the typical included angle formed between the surfaces defining the wedge configuation will be approximately 90°. However, as above, this angular relationship may be produced differently according to particular requirements.

Figure 7:
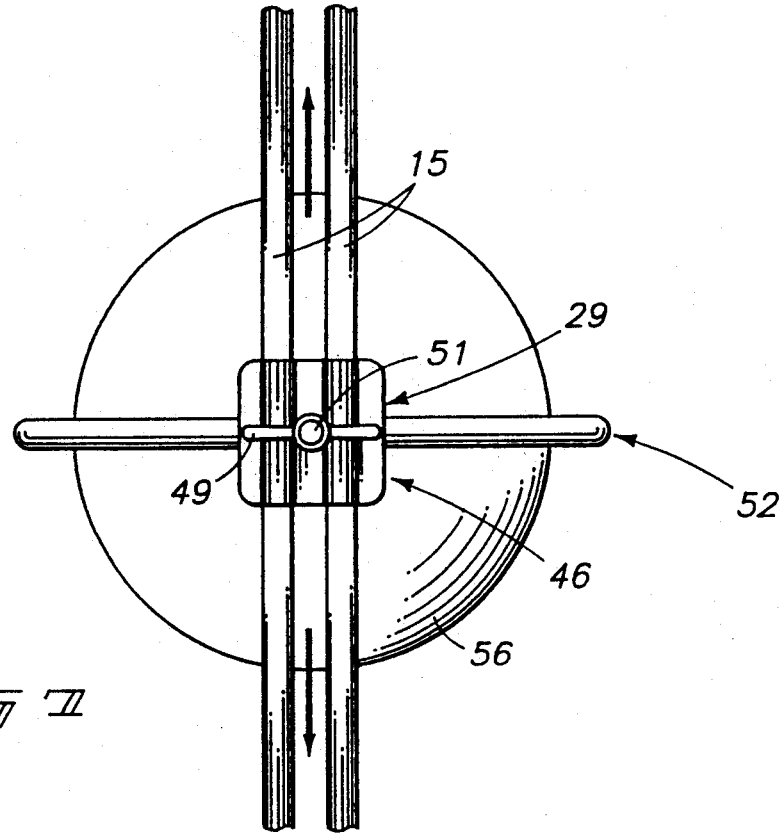
FIG. 7 is a fragmented detailed plan view of a shade mounting means and a base frame.
Figure 8:
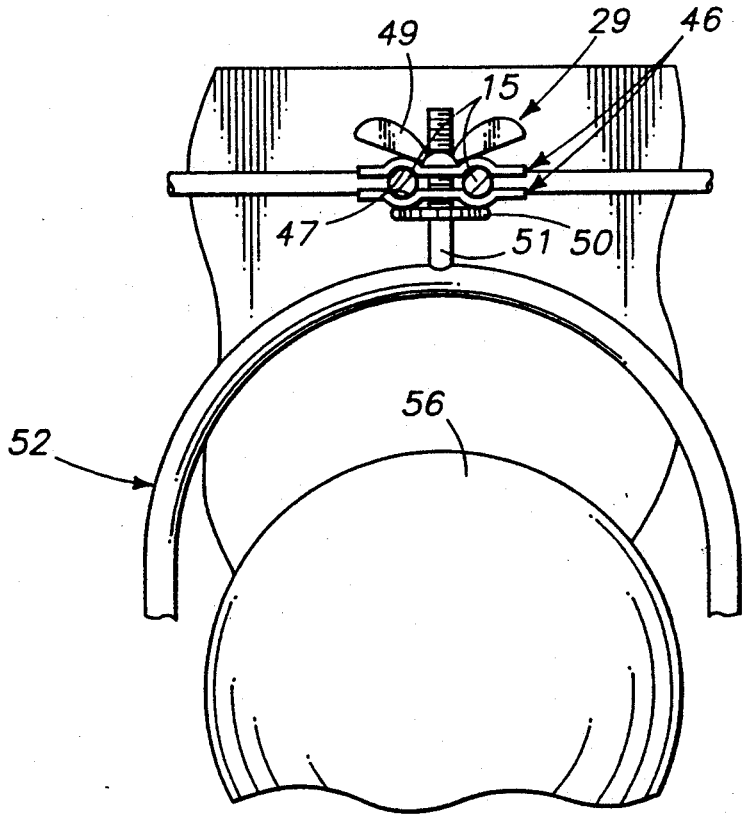
FIG. 8 is a elevational view of the components shown in FIG. 7.
Figure 9:
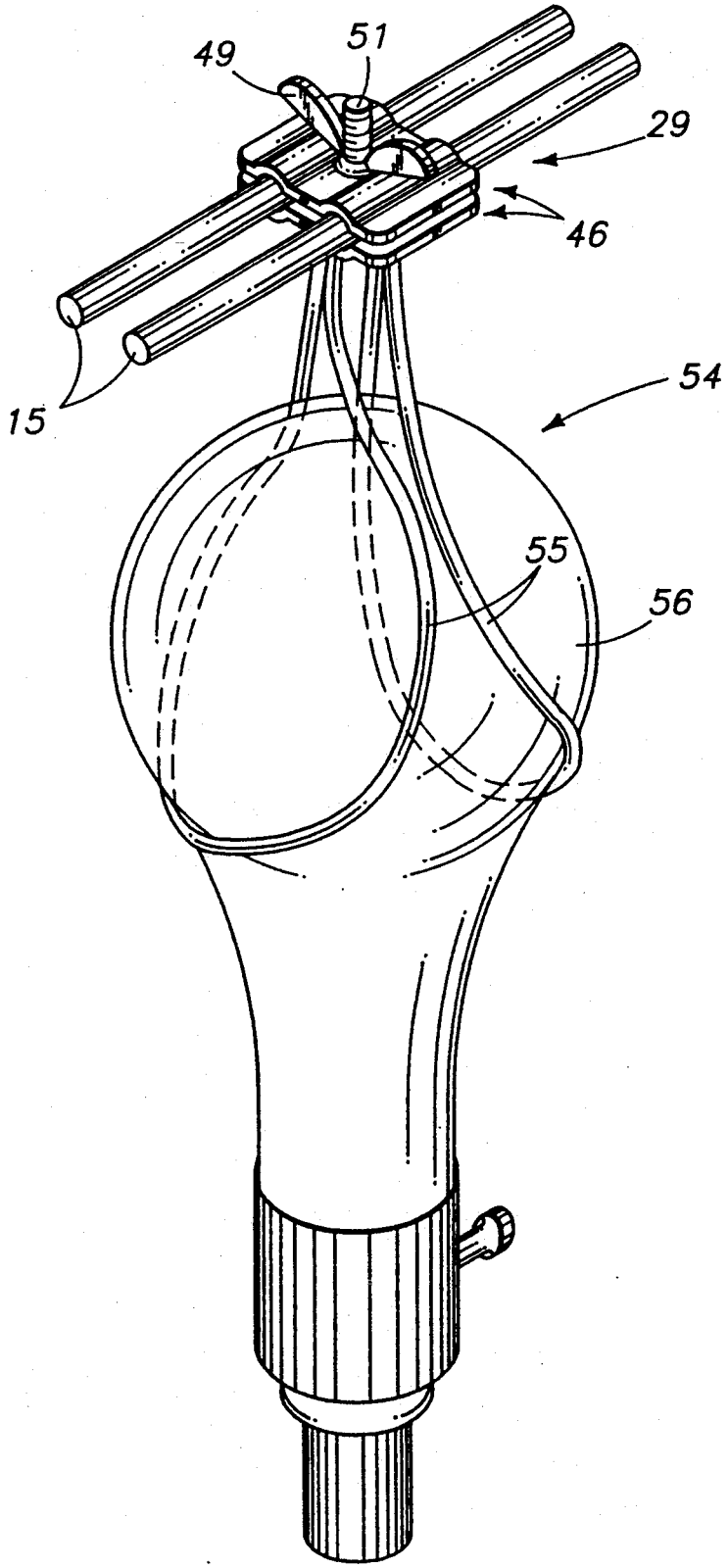
FIG. 9 is a fragmented pictorial view for an alternate base frame with the present shade mounting means.

FIGS. 7 through 9 illustrate details of two forms of the shade mounting means 29. Mounting means 29 is also shown in more general detail in FIGS. 1-6.

The mounting means 29 is generally comprised of slide members 46 that are selectively received over the paired horizontal wire frame members 15. The preferred slide members 46 include shaped indentations 47 formed to receive the paired horizontal wire members 15. The indentations are positioned to face one another and thereby "sandwich" the horizontal frame wires 15 therebetween. At least the top slide member 46 releasably receives an upright threaded post 51 of a base frame 52. It is conceivable that the bottom member 46 be welded or otherwise.secured to the base frame 52. In conventional lamps, the lower member may simply rest on a stationary shoulder 50 (FIG. 8) on a conventional base frame.

The slide members 46 are releasably secured, sandwiching the horizontal frame members 15 between a wing nut or other threaded tightening device 49 and the stationary shoulder 50 (FIG. 8) on the threaded post 51. The wing nut 49 may be selectively tightened to force the slide members 46 together, thereby clamping the horizontal wire frame members 15, and securing the shade to the frame and self supporting lamp base.

The wing nut 49 may also be loosened to release the clamping pressure and allow lateral adjustment of the lamp shade with respect to the substantially upright axis of the lamp base. This permits relative adjustment between the lamp shade and base to facilitate positioning of the lamp shade its particular shaped surface area 19 in close proximity to a structure wall.

The base frame 52 shown in FIGS. 1-8 mounts the lamp shade mounting means operatively to the lamp base by connection directly to the base. The base frame 52 members substantially straddle the light bulb 56 and socket and attach in a conventional manner at bottom ends to the lamp base or to a socket assembly configuration as exemplified in FIGS. 3 and 5. Where appropriate, the base frame 52 may be offset from the lamp base by means of an offset wire conduit 53 as shown in FIG. 5.

The base frame 52 may be formed in other configurations. For example, an alternate base frame 54 is shown in FIG. 9 in which a spring clip 55 is provided to attach the lamp shade and shade frame to a lamp bulb 56. The lamp shade is thereby operatively connected to the lamp base through the bulb. The same adjustment feature using the slide members 46 is provided in this configuration as well.

The present lamp shade 10 with its unique shaped surface and the adjustment capability within the shade mounting means enables attachment of the present lamp shade 10 to existing, conventional forms of self supported lamp bases and frames. The shade 10 could be mounted to an existing self supported table lamp, for example, having an ordinary, substantially cylindrical or otherwise shaded base and conventional base frame or lamp socket. Provision of the adjustment features described above will permit relative postioning of the shade and the base in relation to a structure wall. Additionally, the present lamp shade configuration could also be attached to a conventional self supported floor lamp. Still further, the floor lamps could be provided with shaped base configurations as disclosed above for the lamp shade and base with appropriately shaped surfaces to facilitate positioning closely adjacent structure walls.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A wall conforming shaped lamp shade mountable to a lamp base, comprising:

a frame;

a lamp shade formed over the frame;

wherein the lamp shade and frame are shaped to accommodate a complementary structure wall surface configuration when positioned adjacent thereto; and shade mounting means including a slide member with means for releasably securing the frame and lamp shade to the lamp base for translational sliding movement of the lamp shade relative to the lamp base toward or away from the structure wall surface.

2. A wall conforming shaped lamp shade mountable to a lamp base, as claimed by claim 1 wherein the lamp shade and frame are shaped with a notched section to enable the lamp shade and frame to be positioned adjacent an outside corner of a structure wall, with the outside corner being received by the notch.

3. A wall conforming shaped lamp shade mountable to a lamp base, as claimed by claim 1 wherein the lamp shade and frame are shaped with a flat section to enable the lamp shade and frame to be positioned flush against a flat structure wall surface.

4. A wall conforming shaped lamp shade mountable to a lamp base, as claimed by claim 1 wherein the lamp shade and frame are shaped with an angular wedge configuration section to enable the lamp shade and frame to be positioned with the wedge configuration section fitted within an inside corner of a structure wall.

5. A lamp, comprising:

a freestanding lamp base;

a lamp socket on the base;

a lamp shade;

shade mounting means for operably securing the lamp shade to the lamp base; and wherein the lamp shade and lamp shade frame include a shaped area complementary to a structure wall surface configuration to thereby enable the shaped surface and the lamp base to be positioned in close proximity to the structure wall surface; and shade mounting means including a slide member mounting the lamp shade frame to the lamp base for translational sliding movement thereon and wherein the slide member includes means for attaching the lamp shade frame to the lamp base.

6. A lamp, as claimed by claim 5 wherein the shaped area is formed as a notch to the lamp shade and frame to be positioned adjacent an outside corner of a struture wall, with the outside corner being received by the notch.

7. A lamp with a structure wall conforming shaped lamp shade, as claimed by claim 5 wherein the shaped area is comprised of a flat section to enable the lamp shade and frame to be positioned flush against a flat structure wall surface.

8. A lamp as claimed by claim 5 wherein the shaped area is comprised of a an angular wedge configuration section to enable the lamp shade to be positioned with the wedge configuration section fitted within an inside corner of a structure wall.

9. A lamp as claimed by claim 8 wherein the lamp base includes a shaped section thereon similar to the shaped section of the lamp shade to accommodate a complementary structure wall configuration.

10. A wall conforming shaped lamp shade mountable to a lamp base, comprising:

a frame;

a lamp shade formed over the frame;

wherein the lamp shade and frame are shaped to accommodate a complementary structure wall surface configuration when positioned adjacent thereto; and wherein the frame includes shade mounting means for releasably securing the frame and lamp shade to the lamp base for selective adjustment of the base relative to the lamp shade toward or away from the structure wall surface; and wherein the lamp shade and frame are shaped with a notched section to enable the lamp shade and frame to be positioned adjacent an outside corner of a structure wall, with the outside corner being received by the notch.

11. A lamp, comprising:

a freestanding lamp base;

a lamp socket on the base;

a lamp shade;

shade mounting means for operably securing the lamp shade to the lamp base; and wherein the lamp shade and lamp shade frame include a shaped area formed as a notch to enable the lamp shade and frame to be positioned adjacent an outside corner of a structure wall, with the outside corner being received by the notch.

* * * * *